United States Patent [19]

Davidson et al.

[11] 4,201,292

[45] May 6, 1980

[54] DISPENSER CARTON

[75] Inventors: Thomas L. Davidson, Uncasville; Charles F. Gonet, Voluntown, both of Conn.

[73] Assignee: Robertson Paper Box Co., Inc., Montville, Conn.

[21] Appl. No.: 3,542

[22] Filed: Jan. 12, 1979

[51] Int. Cl.[2] ..... B65D 5/64

[52] U.S. Cl. ..... 206/44 R; 206/45.23; 206/45.29; 206/621

[58] Field of Search ..... 206/44, 44 B, 44 R, 206/45.12, 45.2, 45.21, 45.23, 45.28, 45.29, 604, 620, 628, 634, 621; 229/17 R

[56] References Cited

U.S. PATENT DOCUMENTS

| | | | |
|---|---|---|---|
| 2,002,364 | 5/1935 | Dalles | 229/17 R |
| 3,166,229 | 1/1965 | Sherman | 206/44 |
| 3,366,307 | 1/1968 | Persson | 206/628 |
| 3,438,565 | 4/1969 | Lingt | 229/17 R |
| 3,549,082 | 12/1970 | Simpson | 206/621 |

FOREIGN PATENT DOCUMENTS

| | | | |
|---|---|---|---|
| 927035 | 5/1963 | United Kingdom | 206/470 |

*Primary Examiner*—Herbert F. Ross

*Attorney, Agent, or Firm*—Cesari and McKenna

[57] ABSTRACT

A dispensing carton comprises a generally rectangular enclosure including a top wall, a bottom wall, a front wall, a rear wall and a pair of end walls. Tear lines are formed in the top wall so that at least a section of the top wall can be stripped away to expose the contents of the carton. A relatively rigid flap projects up from the carton at the junction between the top wall and the rear wall with the flap having a lower portion which has more or less the same dimensions as the removable section of the top wall and an upper portion so that, when the top wall section is removed, the flap can be folded down onto the carton with the lower flap portion covering the opening and the upper flap portion projecting through the opening into the carton to form a cover for the carton.

6 Claims, 5 Drawing Figures

DISPENSER CARTON

This invention relates to a dispenser carton. It relates more particularly to a carton of this type which functions as a display and dispenser at the point of sale and as a container for a product after purchase.

BACKGROUND OF THE INVENTION

When merchandising small articles of one kind or another, it is frequently desirable to ship them to the point of sale in a closed container and hang several containers on a rack. All or a portion of the container cover can then be removed to expose the container contents. This enables a customer to remove and purchase one or more of the articles as he or she desires. Often, cartons such as this also include a flap or card which projects from one end of the carton and functions as an advertising surface for the product in the carton and also as a hanger for suspending the carton from the rack so that its contents are readily accessible.

In some cases a customer may desire to purchase the entire remaining contents of a previously opened carton. However, with no provision made for reclosing the carton to properly contain the articles and protect them from dirt and moisture at home, he is reluctant to do so. He either buys a lesser quantity than he intended which is undesirable from the retailer's standpoint or the customer purchases a new carton but is dissatisfied because he has to purchase and pay for more articles than he intended.

Another problem with many prior dispensing cartons of this type is that they are of relatively weak construction so that, when suspended from their rack, they tend to sag and tear due to customers pushing down on the carton as they withdraw articles from it. At the very least, the carton then presents a display which is not particularly pleasing to the eye. Worse still it may give way entirely thereby spilling its contents on the floor.

So too a customer may wish to purchase a full carton. However, if he then tears the upstanding card off, the integrity of the carton may be degraded. On the other hand, if he does not do that, the card may interfere with placement of the box in the home.

Still other cartons of this general type are relatively complex structures requiring an undue amount of board stock and an excessive number of folding and glueing operations so that those cartons are relatively expensive to make.

SUMMARY OF THE INVENTION

Accordingly, it is an object of the present invention to provide a dispenser carton which can be made from a single cardboard blank using a minimum amount of board stock and a minimum number of folding and glueing operations.

Another object of the invention is to provide a dispensing carton which is relatively rugged and resistant to racking and sagging.

Another object of the invention is to provide a carton of this type which can be used as an open dispenser at the point of sale and then be completely closed in the event that a customer wishes to purchase the remaining contents of the carton.

Another object of the invention is to provide a carton which can be suspended from a support to function as a display and a readily accessible dispenser for the contents of the carton and can then be used as a closed container for the remaining carton contents.

Still another object of the invention is to provide a blank for forming a dispensing carton having one or more of the above characteristics.

A further object is to provide a carton of this type with an upstanding supporting and advertising card which can be effectively utilized to maintain the integrity of the carton and as a carton closure.

Briefly, the present carton includes the usual side and bottom walls and a top wall which can be partially or completely stripped away. A flap projecting up at the rear of the carton functions as an advertising flag and permits the carton to be suspended from a rack. However, when the top wall is stripped away to open the carton for dispensing purposes at the point of sale or at the purchaser's home, the advertising flap can be folded down to reclose the carton so that it resembles an ordinary box.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
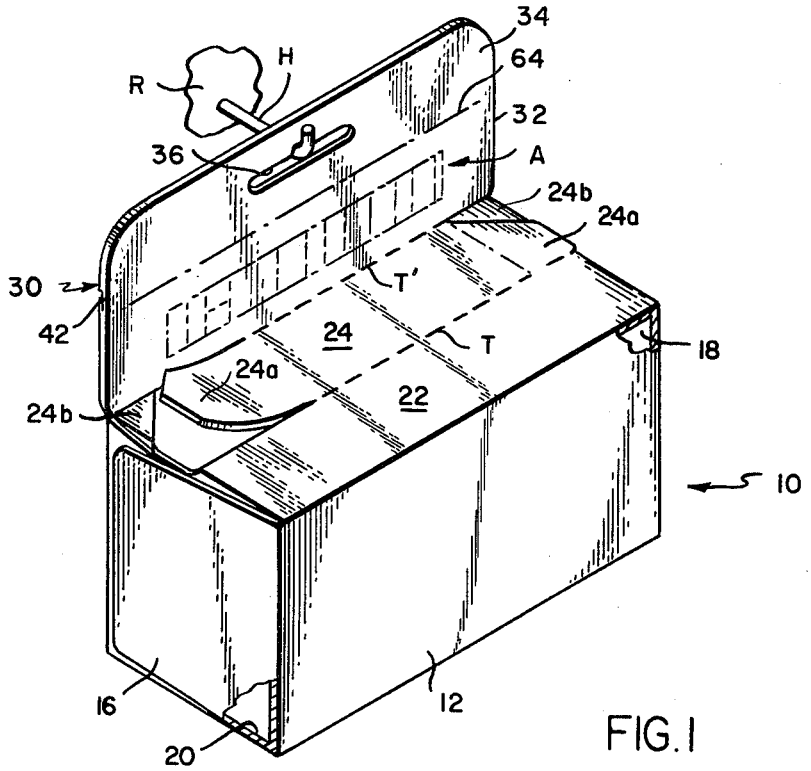
FIG. 1 is a perspective view of a dispenser carton embodying the principles of this invention showing the carton partially open for displaying and dispensing articles therein.
Figure 2:
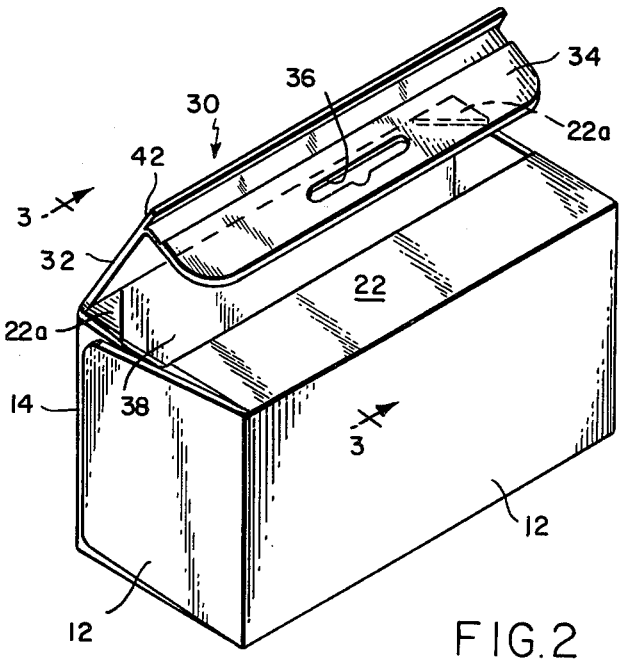
FIG. 2 is a similar view of the carton used as a container with its cover partially closed.

Turning now to FIGS. 1 and 2 of the drawings, the subject carton indicated generally at 10 is arranged to be suspended from a hook H attached to a rack R or other support structure so that the carton is in plain view and readily accessible to potential customers. Carton 10 includes a front wall 12, a rear wall 14, a pair of end walls 16 and 18, a bottom wall 20 and a top wall divided by a transverse tear line T into front and rear sections 22 and 24. Projecting up from the rear wall 14 of the carton is a relatively stiff flap or card indicated generally at 30 comprising a lower portion 32 and a contiguous hinged upper portion 34. Centrally located in portion 34 is an opening 36 for receiving the supporting hook H as shown in FIG. 1. The flap 30 thus not only functions as a support for the remainder of the carton 10, it also can be used to display advertising matter indicated at A relating to the contents of the carton.

Once suspended from rack R, the carton 10 may be opened by stripping away the rear section 24 of the carton top wall along the tear line T at the front of section 24 and along a similar tear line T' connecting section 24 to the flap 30. Preferably small triangular corners **24*b* are struck from section 24** which remain after the section is stripped away to connect and reinforce the carton end and rear walls.

Small tabs **24*a* are hinged to the opposite ends of wall section 24 whose edges project slightly, e.g. 1/32 inch, beyond carton end walls 16 and 18 to facilitate grasping the end of the section 24 and stripping it away from the carton as indicated in FIG. 1. With the wall section 24 removed as illustrated in FIG. 2, the contents of the carton become accessible through an opening 38 between top wall section 22 and the rear wall 14**. Such contents might include small separately packaged articles such as premoistened paper towelettes or other merchandise of that type which may be removed individually or in different numbers from the dispenser carton.

Figure 3:
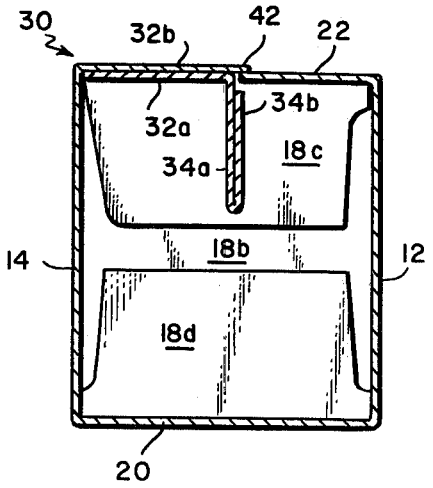
FIG. 3 is a sectional view along line 3—3 of FIG. 2 but with the cover completely closed.

In some cases, the customer may wish to purchase the entire remaining contents of the carton 10 or a full carton. In this event, he simply disengages the flap 30 from hook H and at the point of sale or at home after opening the carton, folds the flap portion 32 down over opening 38 with the flap portion 34 extending into the top of the carton adjacent the edge of the top wall portion 22 as shown in FIGS. 2 and 3. Whereupon it constitutes an ordinary box whose integrity is preserved and which can be stored conveniently.

In this connection, it should be understood that the height of the flap portion 32 corresponds to the rearward depth of the opening 38 left by the removal of the wall section 24. Consequently, that flap portion completely closes the opening 38 in the carton top wall. The flap portion 34 extends down to some extent into the carton as best seen in FIG. 3 and it is made somewhat longer than the distance between the carton end walls 16 and 18 so that there is some frictional engagement between the ends of that flap portion and the end walls to retain the flap portions 32 and 34 in place so that they together function as a conventional cover for the carton 10. The flap portion 34 also helps to keep the cover closed in that the upper edge of its ply **34*b* engages under the edge of wall portion 22 as best seen in FIG. 3**.

Further, when the flap portion 34 is bent relative to portion 32 as shown in FIG. 2 in preparation for inserting it into the carton, a narrow lip 42 is created at the rear of the flap all along the width of the flap. That lip projects out beyond the flap portion 32 and engages the edge of cover portion 22 when the flap is fully folded into place as illustrated in FIG. 3. Thus the lip 42 engagement of the wall portion 22 supports the flap and prevents it from being pushed down into the carton.

Of course, the removable top wall section 24 can be made of any rearward depth with the height of the flap portion 32 being dimensioned correspondingly to provide a complete closure of the opening 38. Likewise the height of the flap section 34 can be made to extend above section 32 a distance depending upon the amount of advertising matter A that is required to be displayed. However, the height of that flap portion should, of course, not exceed the depth of the carton 10 because then it would prevent complete closure of the cover-forming flap portion 32.

As best seen in FIG. 3, the flap 30 is composed of two plies for added strength. That is, the flap portion 32 is composed of adhered-together front and rear plies **32*a* and 32*b*. The lip 42 is actually an extension of ply 32*b* beyond the hinge between the two flap portions 32 and 34. Likewise the flap portion 34 is composed of adhered-together plies 34*a* and 34*b*. Therefore, there is little likelihood of the carton tearing away from its support H under its own weight or due to downward forces applied to the carton by customers removing the carton contents. Likewise the remainder of the carton is quite strong and resistant to racking and sagging due to the reinforcement provided by the remaining top wall section 22 and corner 24*b*** which function as reinforcing webs between the carton front, rear and end walls.

Figure 4:
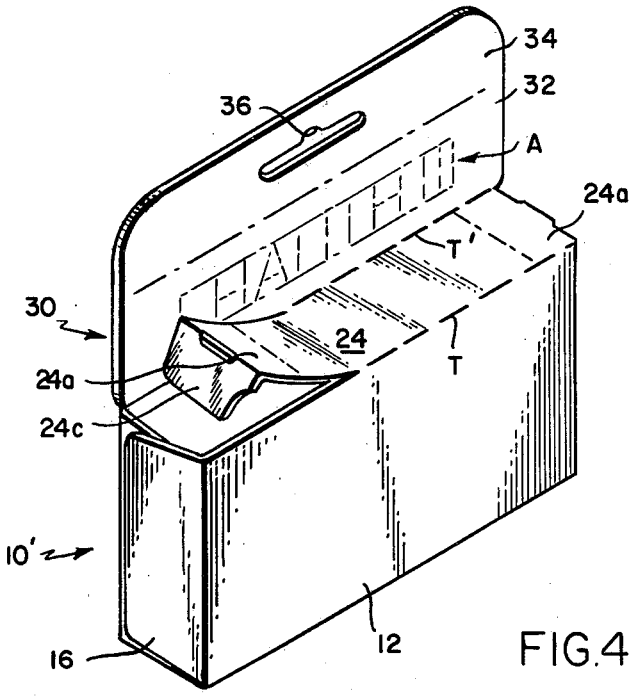
FIG. 4 is a view similar to FIG. 1 showing another carton embodiment.

FIG. 4 illustrates a modified carton embodiment indicated generally at 10' whose removable top wall section 24 constitutes the entire top wall. The various panels on carton 10' are more or less the same as those on carton 10. Consequently they carry the same identifying numerals. The major difference between the two carton embodiments is that the strippable top wall section 24 extends from its tear line T' with the flap section 32 as before all the way to the tear line T at the front of the carton at the upper edge of the carton front wall 12. Also the wall section 24 extends beyond its hinged end tabs **24*a* down into the carton to form auxiliary end flaps 24*c* at the opposite ends of the carton. As with the first embodiment, after section 24 is removed, the flap portions can be folded down to form a cover including a supporting lip which now engages the uper edge of wall 12**.

Figure 5:
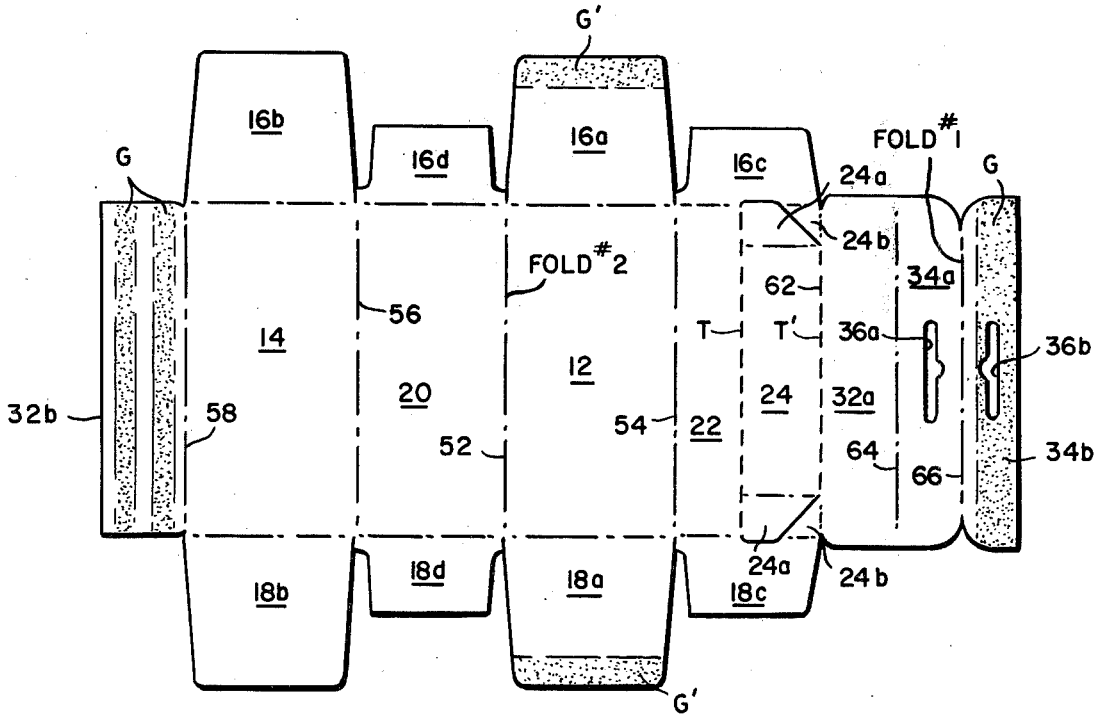
FIG. 5 is a top plan view of the blank for forming the FIG. 1 carton.

Refer now to FIG. 5 which illustrates the blank from which the FIG. 1 carton is formed. The various panels in the blank carry the same identifying numerals as their counterparts in the erected box. The carton front wall 12 is hinged to bottom wall 20 and top wall section 22 along hinge lines 52 and 54 respectively. Bottom wall 20 is, in turn, hinged along line 56 to the rear wall panel 14 whose opposite edge is hinged at line 58 to the ply **32*b* of flap portion 32. Further, top wall section 24 is hinged along line 62 to the ply 32*a* of flap portion 32, the opposite edge of that ply being hinged at 64 to the ply 34*a* of flap portion 34. Finally the opposite edge of ply 34*a* is hinged along line 66 to a mirror image ply 34*b* of flap portion 34. As shown in FIG. 5, the tear lines T and T' are formed by nicks extending between sections 22 and 24 and along the fold line 62 respectively. Registering openings 36*a* and 36*b* are struck from the panels 34*a* and 34*b* to provide the support opening 36 (FIG. 1**).

The carton end wall 16 is actually composed of four flaps **16*a* to 16*d* hinged to panels 12, 14, 22 and 20 respectively which are folded over in the usual way when erecting the carton. Likewise, the carton end wall 18 comprises four flaps 18*a* to 18*d* hinged to the opposite ends of those same panels and folded in the same way to close the carton. Of course, any other suitable conventional end closures may be used to form the end walls 16 and 18**.

To form the carton 10 from the FIG. 5 blank, a glue line G is applied to panel **34*b* as indicated. Similar glue lines G are applied to panel 32*b* at the opposite end of the blank. Then panel 34*b* is folded over onto panel 34*a* as indicated so that the two become adhered together. Next the opposite end segment of the blank is folded at hinge line 52 as indicated so that panels 20 and 14 overlie panels 12 and 24 with panel 32*b* becoming adhered to panel 32*a*. Preferably also there is a pre-break provided along hinge line 56 so that the carton will set up more easily when the time comes to fill it. To erect the carton, the walls 12, 14, 20 and 22 are squared up. Then one set of end wall panels, say panels 16*a* to 16*d*, are folded inward on one another in the usual way. A glue line G' is applied to the outermost panel 16*a* which adheres to the opposite side of panel 16*b* to close off that end of the carton. Then the carton is filled with articles after which the opposite end wall panels 18*a* to 18*d* are folded inward in a similar fashion. A glue line G' is also applied to end flap 18*a* which adheres to the opposite side of panel 18*b* thereby completely closing the carton and protecting its contents. The filled carton is then shipped to the point of sale whereupon at the appropriate time it is supported and its top wall section 24** is opened to display and dispense the carton contents as described above.

A similar blank is used to form the FIG. 4 carton, the main difference being that the tear line T lies on hinge line 54 so that there is no remaining top wall section 22.

It will be appreciated from the foregoing description that the subject carton made from a single cardboard blank using minimum paper stock and using a minimum number of folding and glueing operations should be a very economical container. The carton thus formed from its blank can be shipped in a flattened condition to the source of the carton contents. Then the carton can be erected and filled quite easily, providing an enclosure for articles having complete integrity all the way to the point of sale. At the point of sale, the carton can be supported at an appropriate location to provide a very visible, attractive and readily accessible dispenser for various articles. Further, if desired, a particular customer can purchase a full carton and by manipulating the advertising flap on the carton after its top wall is stripped away to reclose the carton to protect articles in the carton until they are needed.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described.

We claim:

1. In a dispensing carton including hinged-together panels defining a carton front wall, rear wall, bottom wall and a pair of end walls, the improvement comprising A. a completely closed carton top wall, B. means in the carton top wall to facilitate removing at least a section of the carton top wall from said carton to provide an opening into the carton, C. said rear wall including a support panel projecting up at the junction between the carton rear wall and the carton top wall, said support panel including a lower portion whose dimensions correspond substantially to the removable section of the carton top wall and an upper portion hinged to the lower portion so that, when the removable wall section is removed, the opening left thereby can be closed by folding down the lower support panel portion over the opening with the upper support panel portion projecting through the opening into the carton.

2. The carton defined in claim 1 wherein said support panel is composed of at least two adhered-together outer and inner plies of material to strengthen and rigidify it.

3. The carton defined in claim 2 wherein the outer ply of said lower supporting panel portion extends slightly beyond the hinge between the two support panel portions so that when the lower support panel portion is folded down so as to cover said top wall opening, said ply overhangs and engages the front edge of said opening thereby acting as a stop for that portion.

4. The carton defined in claim 1 wherein the length of said upper support panel portion is such that when that panel portion is inserted into said top wall opening it frictionally engages the edges of the opening so as to retain the lower support panel portion in place over the opening.

5. The carton defined in claim 1 and further including lip defining means at the junction of said lower and upper support panel portions said lip engaging the forward edge of the opening in the top wall when the lower support panel portion is folded over said opening and the upper support panel portion projects through said opening into the carton whereby said lip functions as a stop for those panel portions.

6. The carton defined in claim 5 wherein said upper support panel portion has an exposed edge positioned just below said lip which engages under said opening forward edge.

* * * * *